US006139667A

United States Patent [19]

Sanford et al.

[11] Patent Number: 6,139,667

[45] **Date of Patent: *Oct. 31, 2000**

[54] VARIABLE LENGTH TRUSS AND METHOD FOR PRODUCING THE SAME

[76] Inventors: Emmett Barry Sanford, Highway 18 West; Emmett Cecil Sanford, Jr., P.O. Box 473, both of Vernon, Ala. 35592

[ * ] Notice: This patent is subject to a terminal disclaimer.

[21] Appl. No.: 08/999,778

[22] Filed: Aug. 21, 1997

Related U.S. Application Data

[60] Continuation of application No. 08/466,753, Jun. 6, 1995, abandoned, which is a division of application No. 08/052,209, Apr. 21, 1993, abandoned.

[51] Int. Cl.[7] ..... B32B 31/00; E04C 3/16

[52] U.S. Cl. ..... 156/92; 156/257; 156/258; 156/263; 156/267; 52/694

[58] Field of Search ..... 156/92, 257, 258, 156/263, 267; 52/690, 692, 693, 694, 695, 729.4; 144/347, 350, 353, 359, 363, 379

[56] References Cited

U.S. PATENT DOCUMENTS

| | | | |
|---|---|---|---|
| 1,565,879 | 4/1925 | White . | |
| 2,668,606 | 2/1954 | King . | |
| 3,490,188 | 1/1970 | Troutner . | |
| 3,651,612 | 3/1972 | Schmitt | 52/731.1 |
| 3,769,771 | 11/1973 | Shannon | 52/634 |
| 3,991,535 | 11/1976 | Keller et al. . | |
| 4,001,999 | 1/1977 | Chandler . | |
| 4,114,328 | 9/1978 | Lawrence . | |
| 4,336,678 | 6/1982 | Peters | 52/729 |
| 4,435,929 | 3/1984 | Bussell . | |
| 4,463,887 | 8/1984 | Bloys | 144/353 |
| 4,525,974 | 7/1985 | Steidle-Sailer et al. | 52/729 |
| 4,548,014 | 10/1985 | Knowles . | |
| 4,637,194 | 1/1987 | Knowles . | |
| 4,677,806 | 7/1987 | Tuomi . | |
| 4,699,547 | 10/1987 | Seemiller . | |
| 4,745,724 | 5/1988 | Reetz . | |
| 4,787,183 | 11/1988 | Johnston . | |
| 4,852,322 | 8/1989 | McDermid . | |
| 4,862,662 | 9/1989 | Eberle et al. | 52/729 |
| 4,926,593 | 5/1990 | Johnston . | |
| 4,957,186 | 9/1990 | Reetz . | |
| 5,111,861 | 5/1992 | Gore et al. . | |
| 5,509,338 | 4/1996 | Ekker | 83/745 |

FOREIGN PATENT DOCUMENTS

| | | | |
|---|---|---|---|
| 2008043 | 7/1991 | Canada . | |
| 2133776 | 4/1996 | Canada . | |
| 903373 | 2/1954 | Germany . | |
| 3423751 | 1/1986 | Germany | 52/729 |
| 896984 | 5/1962 | United Kingdom | 52/730.7 |
| 1 356 941 | 6/1974 | United Kingdom . | |

OTHER PUBLICATIONS

*BUILDER*, "The Magazine of the National Association of Home Builders", Sep. 1993, p. 155.

*Primary Examiner*—Jeff H. Aftergut
*Attorney, Agent, or Firm*—Smith, Gambrell & Russell, LLP

[57] ABSTRACT

An open web beam composed of wooden top chord and an open web central structure terminated on at least one end by wooden members in the form of a closed web wherein the closed web is reinforced by insertion of a portion of the closed web into a strut and the two chords which have been slotted or grooved for this purpose. The closed be being oriented strand board using structural adhesive without interfering mechanical fasteners in the web.

32 Claims, 6 Drawing Sheets

VARIABLE LENGTH TRUSS AND METHOD FOR PRODUCING THE SAME

This is a continuation of application Ser. No. 08/466,753, filed on Jun. 6, 1995, now abandoned, which is a divisional of U.S. Ser. No. 08/052,209 filed Apr. 21, 1993, abandoned.

This invention relates broadly to the art of construction trusses and joists.

More particularly the invention relates to open web truss designs for application to ceiling, roof and floor joists.

More particularly the invention relates to a process and product for use as trimmable trusses or joist which combine the benefits of open web truss construction with closed web construction providing variable length while conserving the integrity of the factory test requirements and component strength with variable spans.

Truss designs in the prior art envision three broad design types.

Two by ten or two by twelve joists made of solid wood are very common. The major problems associated with these are that they require old growth timber to provide wide enough lumber. In addition, when oriented edgewise, they provide an inferior nailing surface compared with that provided by two by fours oriented flatwise. This is particularly important when adding subfloors and ceilings to the joists since only an approximate location of the supporting member can be found. In addition, span lengths are greatly diminished by the load bearing properties of these timbers.

To address the cost, assembly and load bearing problems, manufactured trusses utilizing two by four chords with an interior webbing have been used. Two basic types encompass the two remaining truss design types.

Open web trusses of several designs are known in the art. An example of an open web truss is White, 1,565,879. White discloses a truss having a web of the depth of the truss which is shaped at either end to fit within a recess in the upper and lower chords which are provided with channels for receiving the shaped ends. The shaped ends are part of a web which has been thickened and provided with a flanged seat for placement of the truss during construction. The web and the chords have had their structural integrity and stress bearing features affected by the process. The present invention maintains structural parameters.

Further, If the seat is removed, as by trimming, the effectiveness and purpose of this structure is negated.

White also provides for a complex and built up leading and trailing edge for purposes of maintaining strength and hanging the truss. The webs making up the I-beam ends are mounted by way of channels in the chords which hold the diagonal struts by compressing the sides of these channels. Fillets are pressed into the wood in order to anchor this engagement.

These trusses are particularly described to define a non-trimmable truss. The net effect of trimming a truss of this form would be to affect the structural integrity built into the truss by virtue of the fillets and cause potential splitting at the channels holding the struts.

A similar design is disclosed in the pressed in dovetail type joint disclosed in Keller, et al 3,991,535. Keller shows the use of grooved members between parallel tongues (corresponding to the chords of White) for receiving an I beam of a truss (corresponding to the webs of White).

Keller discloses the difficulty of using dovetail joints and addresses a method of improving this design. Keller discloses the use of glue in order to strengthen the glued dovetail of the joints.

The invention is directed to a joint which is self clamping in order to avoid or decrease the need for structural improvements.

These are shown as incremental portions of a partially open web truss in Keller. Keller also fails to utilize two by four open webbing, also generally referred to as cross webbing which adds strength and reduces costs of construction as well as enhancing the crush strength of the interior web and providing greater opportunity to run conduit and pipes through the component.

King, 2,668,606 shows an I-beam utilized in the end piece of prefabricated steel beams.

Seegmiller, 4,699,547 shows a variable length truss and the problems of maintaining structural integrity of the members is indicated.

In all of the patents utilizing wooden members, the shape and structure and therefore the integrity of the web members has been altered since the structure can be kept within limits by maintaining the length of the truss.

One of the problems recognized by the present example is that I-beam construction of this type results in an inability to make on site corrections to the length of trusses. This problem can result in the need to re-manufacture the entire truss.

To address this problem in the past, construction techniques used have included a closed web of the type shown in Keller extending the entire length of the structure. As with Keller, this creates a number of problems. First, at least a portion of the interior webbing is closed and cannot be used for running lines or conduit without bracing, known generally in the art as web stiffeners, being added and calculations being necessary for determining the stability and crush strength of the altered bracing. In order to have a safety factor built in solid web construction as designed for cutting into variable lengths with a varying location for the load has required that the entire beam be made of a solid web.

Note that Keller could not be cut without raising a number of questions as to crush strength and load bearing location. At a very minimum web stiffeners would need to be used, again requiring engineering on the site.

The closed truss is the most common variable length truss. Closed truss design suffers from several construction problems. First, the design requires a great deal more material, having a closed volume. Second the design has difficulty with respect to working within the area defined by the interior of the truss since it is solid and must be cut for additional work. This provides for two problems. First, the strength of the truss may be affected by the work. Second, a great deal of time and equipment may be necessary in order to manufacture a space in which to work. Other related problems may exist as a result of these general problems including the need to use "web stiffeners" and engineer where holes may be made and where web stiffeners are to be placed.

In addition to other reasons, the weight of these types of trusses make them hard to ship and hard to work with.

The major problems with the solid web, other than the inability to use it easily in the field without engineering to pass conduit, is the cost. Solid webbing of the type needed to distribute stress is an expensive value added wood manufactured product comprises of glue and chips compressed together.

The prior art has failed to date to provide an open web truss which has a variable length and this failing has required that all cross web construction be made to order requiring huge risks of error, high turn around times and inflexibility for the end user. The prior art also fails to show a trimmable truss which does not require on site modification to maintain crush strength.

The prior art also fails to show a method for constructing trusses with web strengtheners in place at a low cost.

It is therefore the primary object of the invention to provide a new truss or joist incorporating the benefits of open webbing with variable length structural components required in the industry.

It is a further object to provide a structural components which can replace expensive and environmentally unsound two by ten or two by twelve floor and ceiling joists.

It is therefore an object of this invention to produce a truss which can be of variable length without affecting the structural integrity of the truss I-beam section and maintaining a particular crush strength. It is a further object to provide a varying location for the load bearing surface.

It is a further object of the invention to provide a truss which has a variable load point on either end of the truss.

It is further object of the invention to produce trusses of variable lengths having trimmable ends without requiring on site engineering.

It is a further object of this invention to teach a method of constructing trusses of variable length.

It is a further object of the invention to teach a method of simplifying cross web truss construction.

It is a further object of this invention to disclose a system for construction utilizing variable length trusses.

These and other objects and advantages of the invention will become better understood hereinafter from a consideration of the specification, with reference to the accompanying drawings forming a part thereof and in which like numerals correspond to parts throughout the several views of the invention.

In accordance with the present invention, there is provided a structural component comprising (a) a top chord member means for receiving load and trimming defining at least one weight bearing end; (b) a bottom chord member for receiving load and trimming defining a left and right end; (c) an open web means for connecting the top and bottom chords; and (d) at least one load bearing solid web located at the at least one weight bearing end of the chord members and occupying the space within the load bearing surface of the chords.

Also in accordance with the present invention, there is provided a method of constructing floor and ceiling joists utilizing open web construction without having exact span specifications comprising preparation of a series of trimmable open web members of variable length having closed web ends for trimming; determining by mental operation the number of joists of each size are needed utilizing the desired spans; and trimming the joists of the appropriate size on the site to fit within specific parameters of the site as constructed.

GENERAL DISCUSSION OF THE INVENTION

1. Technology

All products envisioned under this patent would be designed in accordance with the National Design Specifications (1991) and the recommendations of the Truss Plate Institute (PCT-80). Thus, compliance to local building codes would be assured.

Modern, high strength, structural adhesives and special equipment make possible the fabrication of end sections without the use of any mechanical fasteners so that lengths may be modified in the field.

¾" OSB (oriented strand board) is used to maintain strength away from the we stiffeners used.

For architects and volume purchasers, technical assistance from industry experts and professional engineers would be available where necessary for the method of use.

2. The Advantages of the system would include:

A. In-field customization for a closer hand fit.

B. Higher strength allows longer spans with greater on-center spacing-resulting in a net savings in total board-feet of wood fiber (about 12% less than typical 2×12 construction) and less deflection.

C. Open web construction allows for easy passage of duct work, conduit and pipe throughout the length of the TrimJoist-no more hole cutting or notching with consequent problems.

D. The 4×2 chord orientation provides a greater nailing surface for decking, thereby reducing squeaks and giving a more rigid floor system. Minimum chord grade is #1 SP in the preferred embodiment.

E. Environmentally Friendly-all wood fiber can be supplied from plantation-grown trees. Unlike 2×12s, no "old growth" forest lumber is required when framing with TrimJoist.

Examples of the structural aspect of inventions built within the parameters of the disclosure set forth herein follow in the following tables:

SPAN/DEFLECTION TABLE

| Stock Length | 4' | 6' | 8' | 10' | 12' | 14' | 16' | 18' |
|---|---|---|---|---|---|---|---|---|
| Span Minimum | 1'–9" | 3'–9" | 5'–9" | 7'–9" | 9'–9" | 11'–9" | 13'–9" | 15'–9" |
| Range Maximum | 3'–9" | 5'–9" | 7'–9" | 9'–9"' | 11'–9" | 13'–9" | 15'–9" | 10'–9" |
| Max Live Load Deflection | .01" | .01" | .03" | .06" | .11" | .20" | .34" | .52" |
| Max Total Load Deflection | .02" | .02" | .04" | .08" | .17" | .30" | .50" | .77" |
| Maximum L/D | 4.3 | 6.4 | 8.5 | 10.7 | 12.8 | 14.9 | 17.1 | 19.2 |

UNIFORMLY DISTRIBUTED PSF LOADING (0% Stress Increase)

| | | | | | |
|---|---|---|---|---|---|
| Top Chord Live: | 40.0 | 50.0 | 60.0 | 70.0 | 80.0 |
| Top Chord Dead: | 10.0 | 12.5 | 15.0 | 17.5 | 20.0 |
| Bottom Chord Live: | 0.0 | 0.0 | 0.0 | 0.0 | 0.0 |
| Bottom Chord Dead: | 10.0 | 12.5 | 15.0 | 17.5 | 20.0 |
| TOTAL LOAD: | 60.0 | 75.0 | 90.0 | 105.0 | 120.0 |
| SPACING: | 24.0" | 19.2" | 16.0" | 13.7" | 12.0" |

Strongback Note (Web strengtheners): By way of example, the invention envisions in certain cases web fasteners when utilizing to by four construction. For example, a 2×4 #2SP (or equal) strongback is required when span exceeds 9'–9". Install perpendicular to one vertical member at either side of center chase. Attach using 2–10d nails, staggered through strongback into vertical member. Strongback is to run continuously and be properly nailed to each member. If splicing is necessary, use 4' long scab centered over each splice and attach using 10d nails at 4" c/c spacing.

Anchorage Note: Web strengtheners would be attached with device(s) deemed suitable for use in conjunction with provided support (see architect or building designer).

BRIEF DESCRIPTION OF THE DRAWINGS

For understanding of the nature and objects of the present invention, reference should be made to the following detailed description taken in conjunction with the accompanying drawings in which like parts are given like reference numerals and wherein.

1.

2.

3.

4.

5.

DETAILED DISCUSSION OF THE PREFERRED EMBODIMENT(S)

Figure 1:
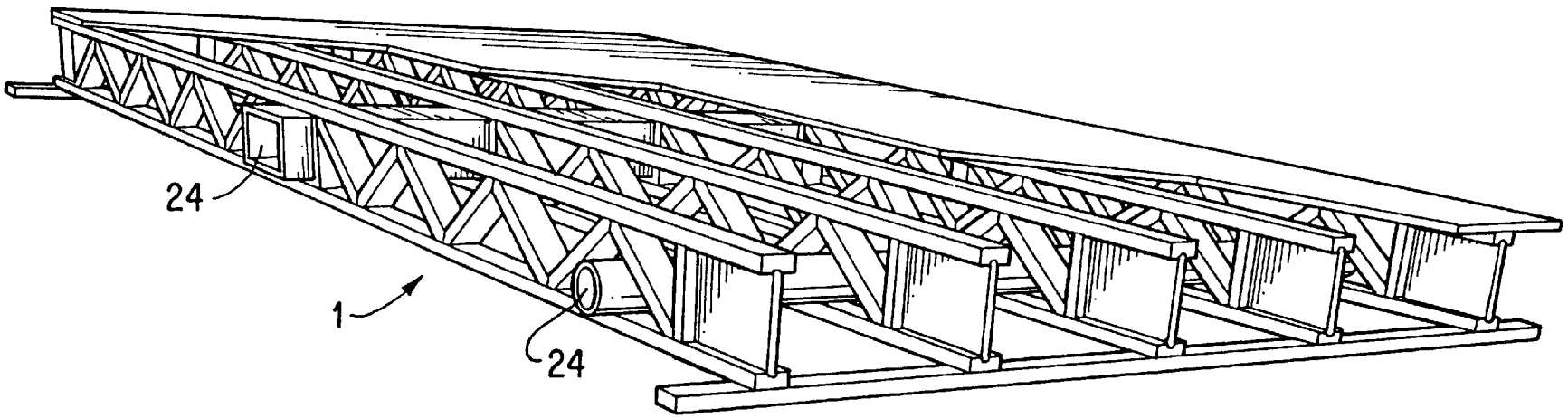
FIG. 1 is a perspective view of the preferred embodiment.
Figure 2:
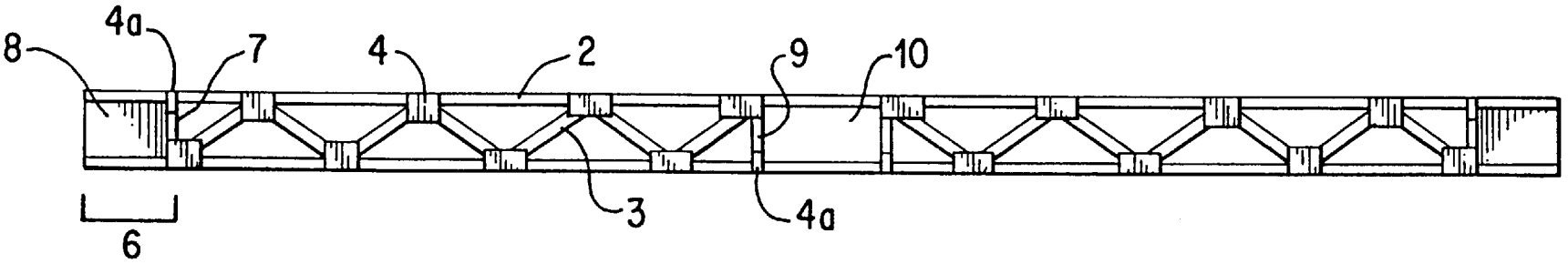
FIG. 2 is a cross sectional view of FIG. 1 through the A—A axis.

As can best be seen by reference to FIG. 1, the structural component system 1 is constructed of a series of individual truss members as shown as 2 in FIG. 2 and the ends of the structural component are constructed of wooden flanges separated by a vertical wooden solid web material.

As can best be seen by FIG. 2, each of the cross member 3 is constructed generally using cross beams 3 and chords 5. An end unit 6 comprised of a strut 7 and a closed or solid web 8 complete the interior portions. The chords are bound to the struts 7 and the cross members 3 utilizing metal fasteners 4. These fastener 4 are known in the art and appear as a metal sheet out of which sharp points or nails have been punched. Typically, these fasteners 4 need to be in place on both sides of the cross beams 3, struts 7 and chords 11 and 12. A smaller fastener 4*a* is used in order to secure the top or bottom of vertical beams 9 defining duct opening 10 and the top of struts 7.

The strut may be slanted as required by roof type truss members.

Figure 3:
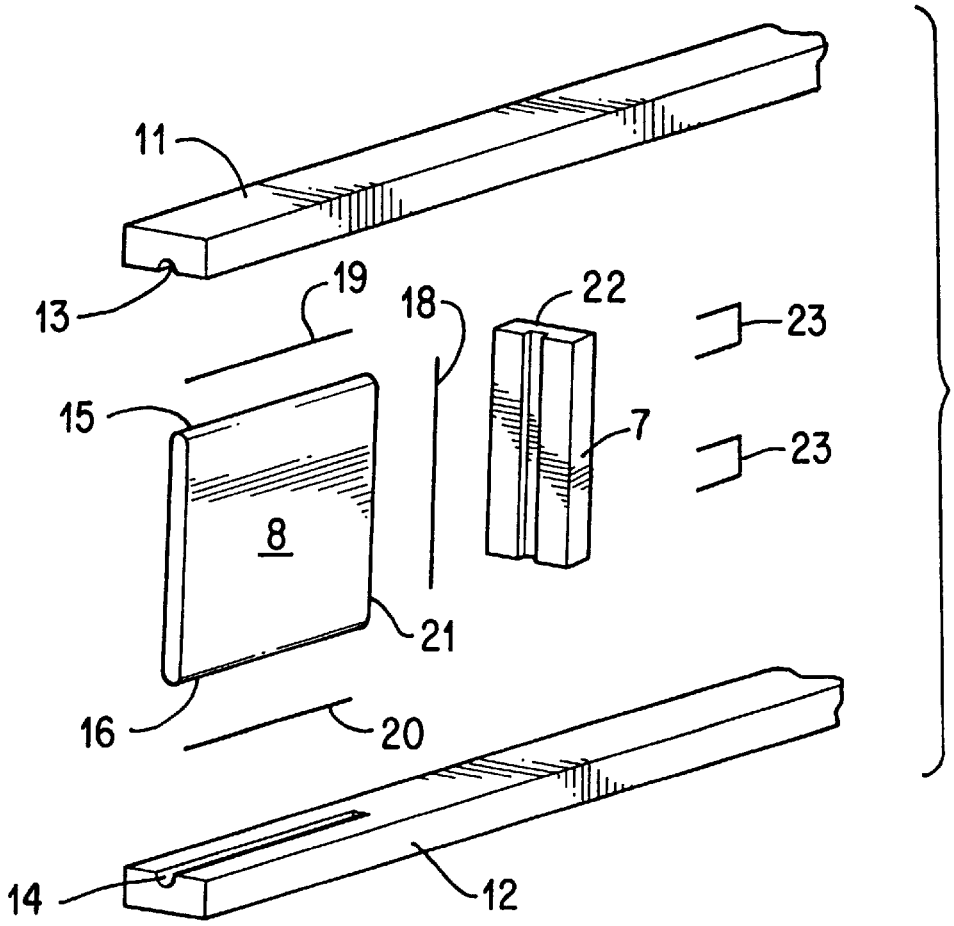
FIG. 3 is a break down of a detailed section of the trimmable I-beam used in FIG. 1.
Figure 4:
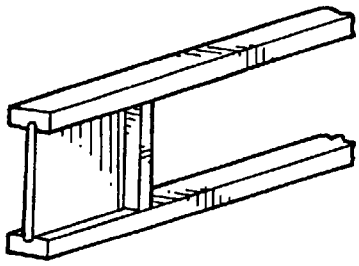
FIG. 4 shows the I-beam of FIG. 3 as assembled.

As can best be seen by reference to FIG. 3 and 4 a key element of the invention is the end unit 6. End unit 6 is comprised on the weight bearing end of the top chord 11 and bottom chord 12. The ends of chords 11 and 12 have been fitted to have a top groove 13 and a bottom groove 14. These grooves 13 and 14 correspond to the top plug 15 and bottom plug 16 defined by the top and bottom rounded ends of the solid web 8. The grooves are typically ½" in a 2×4 chord to maintain thickness of the 2×4 during curing and when weight is supplied during use.

The grooves 13 and 14 and corresponding plugs 15 and 16 are rounded in order to provide a smooth stress profile when pressed together tightly, as by the construction technique described below for making the truss or by loads pressing on the truss in a construction setting. Square or non-rounded openings as are present in the prior art at these locations result in stress singularities which can cause cracking. By providing semi-circular grooves, the stresses present are evenly distributed without affecting the strength of the lumber. Typically, in a two by four, these grooves would be approximately ⅓ of the depth of the two by four. This shaping also allows for a better method of manufacture by allowing easier insertion with the plugs 15216.

Closed web 8 is longer than strut 7 by the combined depth of grooves 13 and 14. Strut 7 has a height defined by the spacing desired between the top chord 11 and bottom chord 12.

Glue line 18 serves to fix the side 21 of closed web 8 into a slot 22 in the strut 7. In addition, in order to maintain the location and pressure on the glue line 18 during curing, metal staples or pins 23 are used to further secure the strut 7 to the side 21 of closed web 8.

Top glue line 19 and bottom glue line 20 are used to secure top plug 15 and bottom plug 16 into top groove 13 and bottom groove 14 respectively. The metal pins 24 cannot extend into the closed web 8 a greater distance than that encompassed by the sides of the slot 22. Slot 22 and the side 21 of web 8 are squared to facilitate the introduction of the pins 23. The slot 22 and side 21 may be squared since they do not bear significant and controlling stresses.

The length of the grooves 13 and 14 and corresponding length of the top 15 and bottom 16 of closed web 8 may be different without departing from the inventive concept embodied herein overall depth from top to bottom amy also vary-length of side 21 on FIG. 3 can vary as well.

The combination of chords and strut and closed web as described above may form a trimmable I-beam without sacrificing strength or deflection tolerances utilizing normal two by four construction for the chords and strut and having the closed web comprised of oriented strand board having a top grooved face corresponding in shape to the top groove and a bottom grooved face corresponding to the shape of the bottom groove so as to form a fit is joined by structural adhesive by joining the top groove and bottom groove to the top and bottom grooved faces respectively.

The real benefit of having the trimmable end in combination with the open web construction can be seen by reference to FIG. 1. As seen by FIG. 1, the running of conduit 24 is simplified by having the open web design. Because the end of the structural components 2 is capable of modification, the structural components 2 may be mass produced instead of job ordered. Close tolerances can be maintained during factory assembly. Unlike a solid web as is known in the art, no special cuts need to be made in the interior, the components are strengthened by struts resulting in an open web and less material needs to be used.

The solid web further comprises an indicator means for displaying the amount of the solid web which may be removed without compromising the load of the solid web.

This results in a substantial savings in turn around time, cost savings, material quantity and weight savings, and labor savings since the engineering of specific trusses is taken care of prior to delivery. Other aspects of engineering required by cutting openings for conduit are also eliminated.

The width and height of the solid web 8 for the invention is defined by the requirements of chord load in the center of the open web and the fact that a minimum amount of length solid webbing 8 is desired to keep the web stiffener 7 effective and to control costs. As described below 2' of solid webbing 8 allows for mass production usage.

In addition, by having these variable length trusses in several sizes, they may be stocked like two by twelve truss members allowing for easier availability than with prior art products.

Finally, as described in more detail below, the construction of this particular type of truss provides for an improved method of construction of open web structural components.

The method for using the members described herein envisions a line assembly of the components.

First, the size of the unit must be determined and engineered using known specifications for open web cross web construction reduced for the length of trimmable closed webbing on at least one side of the truss. In the preferred embodiment, the closed webbing appears on either side to allow easy use.

In order to allow that only a single strut 7 is necessary per side, thereby avoiding the need for on site web stiffening, typically only one foot on either side of the truss 2 utilizes closed webbing 8. Closed or solid web 8 allows for a variable bearing point or load bearing surface as apposed t a fixed bearing part or surface as in other open web construction. It is obvious given the disclosure that web stiffening may be provided at other locations to allow for longer runs of closed webbing 8 as by having either side of the strut 7 grooved to receive the front of one section of closed webbing and the back of another section of closed webbing.

Figure 6:
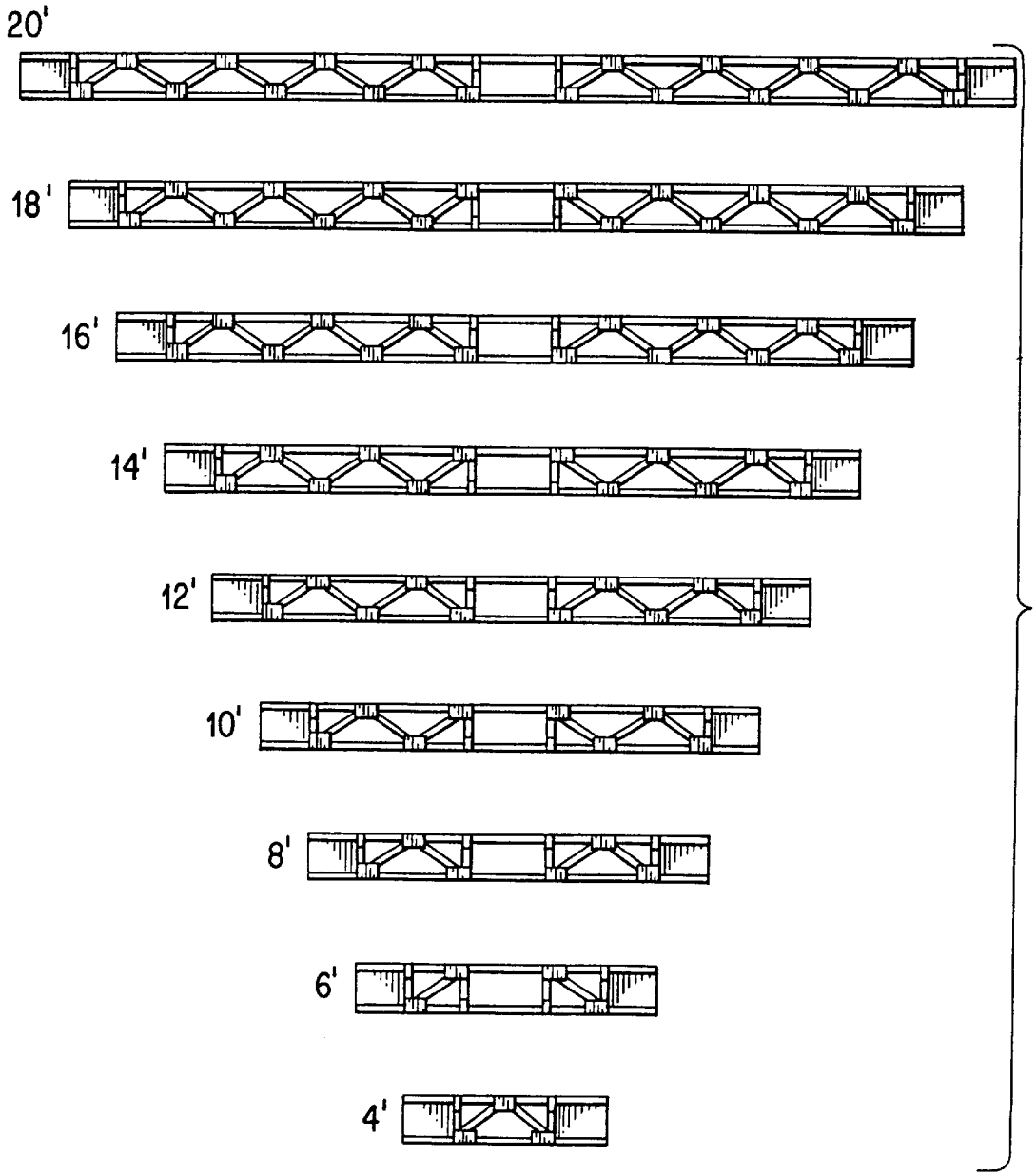
FIG. 6 shows the use of succeedingly two foot increases in beam size for purposes of use of the product in construction.

The sections determined necessary for typical use as shown in FIG. 6 would include sections of 20 feet, 18 feet, 16 feet, 14 feet, 12 feet, 10 feet, 8 feet, 6 feet and 4 feet. Every 4 foot section typically would have two cross members 3. Every 6 foot section would have two cross beams 3 and two vertical beams 9 to define a square duct opening 10. For all the longer trusses, for every two feet added, an additional two cross 3 would need to be added. The beauty of this system is that, since all of the truss sections are trimmable by two feet, every imaginable size up to the maximum span of 24 feet (the maximum being arbitrarily determined), is included.

Because this provides for a series or family of sections, which may be assembled by size needed, it is possible to extend the size without changing the basic specifications. Because all sizes are covered, a warehouse may stock the product as an alternative to more expensive solid web units or two by twelve or ten units.

A method of constructing floor and ceiling joists utilizing open web construction without having exact span specifications is disclosed by:

1. preparation of a series of trimable open web member of variable length having closed web ends for trimming;
2. Determining by mental operation the number of joists of each size are needed utilizing the desired spans;
3. Trimming the joists of the appropriate size on the site to fit within specific parameters of the site as constructed.

Figure 5:
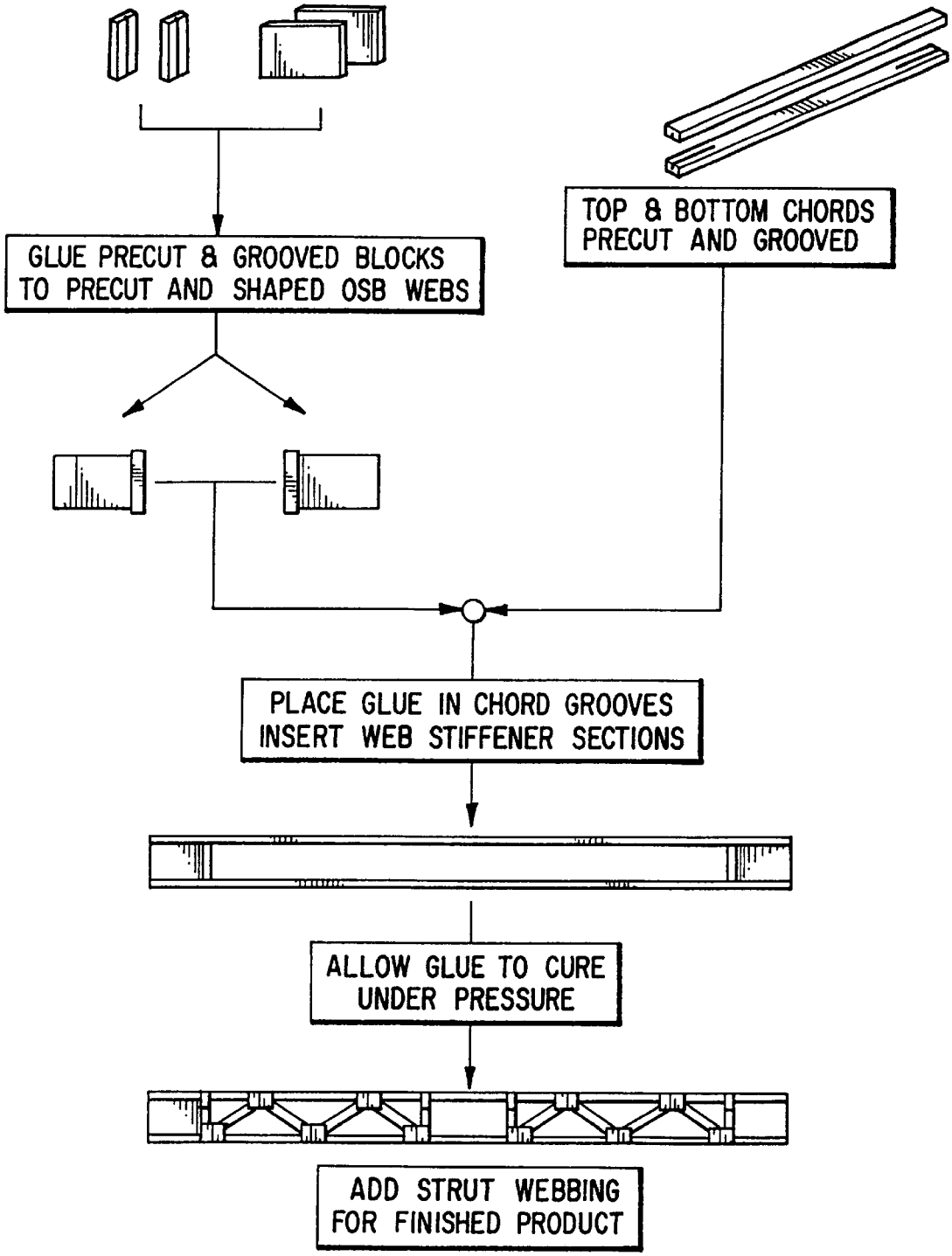
FIG. 5 shows the process described herein for making Truss sections using the technology disclosed in the specification.
Figure 5A:
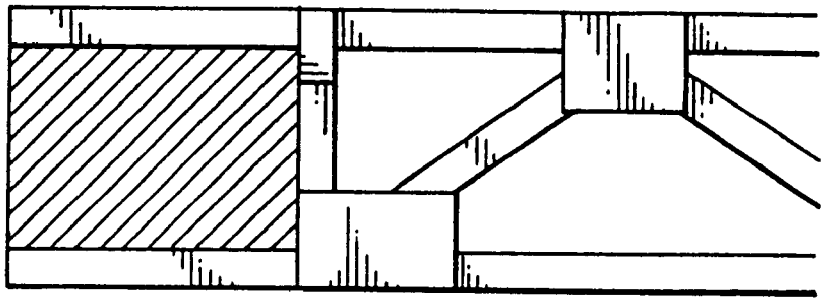
FIG. 5*a* is a typical square cut detail.
Figure 5B:
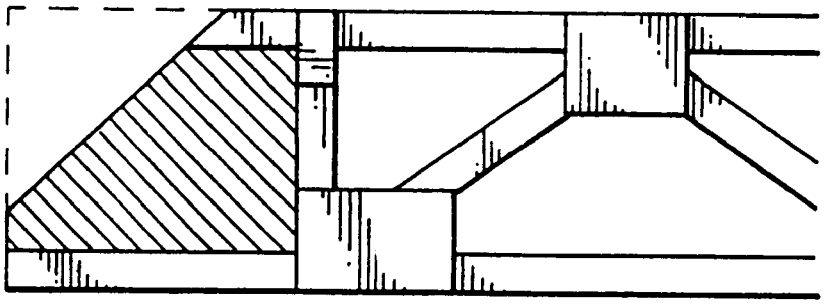
FIG. 5*b* is a tpyical rafter cut detail, 6.

The method envisioned for producing a superior and simplified cross web truss utilized in this specification can be set out as several steps as illustrated in FIG. 5.

The first step in the production of units of variable sizes having an open web design with a trimmable end comprises the step of:

(a) determining the separation distance of the cords;

(b) next would be cutting the two struts in the desired determined length to maintain the desired space between the chord members;

(c) cutting square cuts or slots within the struts to receive the solid web;

(d) cutting a solid web so as to have a side to fit within the square cuts or slots and extend to form a plug on either side of the strut;

(e) cutting or molding the solid web so as to form plugs having curved ends on either side of the struts;

(f) placing glue within the square cut or slots;

(g) placing the web and struts within a jig to align the square cut on the side of the web with the square cut on the strut;

(h) compressing the side of the web within the square cut;

(i) fixing the web to the strut with two staples to maintain the position and tension on the glue during the setting so that there is a mounting of the length of solid webbing to the strut and perpendicular to strut at a set location on the strut and running perpendicular to the intersection of the strut with the chord member (and extending beyond the point of intersection of the strut with the chord member so as to allow the chord member to be cut to receive the solid webbing;

(j) cutting grooves within the top chord to receive the portion of the solid webbing extending beyond the point of intersection of the strut and cutting groove within the bottom chord to receive the portion of the solid webbing extending beyond the point of intersection of the strut corresponding and opposite to the location of the cut in the top chord so that when the top plug and bottom plug are within the corresponding the grooves, the top chord and the bottom chord are aligned.

(k) placing the bottom chord on a rack;

(l) securing the bottom plug to the bottom groove on at least one end of the bottom chord utilizing a glue line in the top groove;

(m) securing the top chord to the top groove so as to align the chords utilizing a glue line in the bottom groove; securing the top chord and top plug and bottom chord and bottom plug on either end of the chords. The use of the separator described in FIG. 3 and 4 and steps a–i is particularly important as the separation defined by the separator is key to the truss strength as to central chord stress as opposed to bearing stress on the closed web on either end.

(n) putting a top rack on top of the bottom rack;

(o) compressing the top rack onto the bottom rack as by compressing one rack to the other;

(p) inserting sections of cross webbing within the space formed by the at least one strut between the chords.

Because of the many and varying and different embodiments which may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A method of making a variable length truss having top and bottom chord members and interior open webbing for installation in a structure comprising the following steps:

(a) forming a first strut having a top and bottom with the distance between the top and bottom of said first strut being equal to the desired spacing between the chord members so that the top of said first strut contacts the top chord member and the bottom of said first strut contacts the bottom chord member, with said first strut being spaced inwardly from one end of the chord members which defines a first end of said truss;

(b) mounting a first solid web member having a top, a bottom, an inboard side and an outboard side to said first strut by inserting said inboard side of said first web member into a vertical slot formed in an outboard side of said first strut with the top and bottom of said first web member extending beyond the top and bottom of said first strut;

(c) mounting the top chord member to the top of said first web member by seating the top of said first web member in a first longitudinal groove in a bottom surface of the top chord member with said first web member being outboard of said first strut;

(d) mounting the bottom chord member to the bottom of said first web member by seating the bottom of said first web member in a second longitudinal groove in a top surface of the bottom chord member with the bottom chord member having a bottom surface thereof beneath said first strut and said first web member defining a first load bearing surface for said truss, and said outboard side of said first web member forming an outer surface of said truss; and (e) mounting a plurality of open web members inboard of said first web member to interconnect the top chord member and the bottom chord member and thereby define the interior open webbing;

(f) at said first end of said truss, in steps (a) to (d), means including the top chord member, the bottom chord member and said first web member forming a first weight bearing I-beam section (1) for supporting said truss on the first load bearing surface in the structure, and (2) for being trimmable up to a distance as defined by the length of said first web member when necessary during installation in the structure to change the length of said truss.

2. The method of claim 1 further comprising the step of placing glue within the grooves formed in the top and bottom chords and in the slot formed in said strut.

3. The method of claim 2 further comprising the step of fixing said first web member to said first strut with at least one staple to maintain the position and tension on the glue as the glue sets.

4. The method of claim 1 further comprising the step of aligning the grooves in the top chord and bottom chord so that when the top of said first web member is inserted into the top chord groove and the bottom of said first web member is inserted into the bottom chord groove the top chord and bottom chord are parallelly aligned.

5. The method of claim 1 further comprising the step of placing said first web member and said first strut within a jig to align said first web member to said first strut.

6. The method of claim 1 further comprising the step of placing said first web member and chords in a jig so as to align said first web member with the top and bottom chord members.

7. The method of claim 5 further comprising the steps of:

compressing said inboard side of said first web member within into said vertical slot.

8. The method of claim 7 further comprising the steps of:

placing the bottom chord member on a bottom rack;

putting a top rack on top of the top chord member; and compressing the top rack onto the bottom rack by compressing one rack relative to the other rack.

9. The method of claim 1 further comprising the steps of:

(g) mounting a second solid web member having a top, a bottom, an inboard side and an outboard side to a second vertical strut by inserting said inboard side of said second web member into a vertical slot formed in an outboard side of said second strut with the top and bottom of said second web member extending beyond the top and bottom of said second strut;

(h) at a second end of said truss, mounting the top chord member to the top of said second web member with said second web member outboard of said second strut by seating the top of said second web member in a third longitudinal groove in a bottom surface of the top chord member;

(i) at said second end of said truss mounting the bottom chord member to the bottom of said second web member by seating the bottom of said second web member in a fourth longitudinal groove in a top surface of the bottom chord member so that the top of said second strut contacts the top chord member and the bottom of said second strut contacts the bottom chord member, the bottom chord member having a bottom surface thereof beneath said second strut and said second web member for defining a second load bearing surface for the truss, and said outboard side of said second web member forming an outer surface of said truss;

(j) at said second end of said truss, in steps (g) to (i), means including the top chord member, the bottom chord member and said second web member forming a second weight bearing I-beam section (1) for supporting said truss on the second load bearing surface in the structure, and (2) for being trimmable up to a distance as defined by the length of said second web member; wherein said truss is trimmable a total distance as defined by the sum of the lengths of said first and second web members when necessary during installation in the structure to change the length of said truss.

10. A method of installing said truss of claim 9 comprising the steps of:

trimming the first and/or the second weight bearing I-beam section of said truss when necessary during installation in the structure to change the length of said truss; and supporting said truss on the first and second load bearing surfaces in the structure.

11. The method of claim 9 wherein said first web member and said second web member are each one foot long.

12. The method of claim 1 wherein said first web member is one foot long.

13. A method of making a variable length truss having top and bottom chord members and interior open webbing for installation in a structure comprising the following steps:

(a) forming a first strut having a top and bottom with the distance between the top and bottom of said first strut being equal to the desired spacing between the chord members so that the top of said first strut contacts the top chord member and the bottom of said first strut contacts the bottom chord member, with said first strut being spaced inwardly from one end of the chord members which defines a first end of said truss;

(b) mounting a first solid web member having a top and a bottom to said first strut by inserting a side of said first web member into a vertical slot formed in an outboard side of said first strut with the top and bottom of said first web member extending beyond the top and bottom of said first strut;

(c) mounting the top chord member to the top of said first web member by seating the top of said first web member in a first longitudinal groove in a bottom surface of the top chord member with said first web member being outboard of said first strut;

(d) mounting the bottom chord member to the bottom of said first web member by seating the bottom of said first web member in a second longitudinal groove in a top surface of the bottom chord member with the bottom chord member having a bottom surface thereof beneath said first strut and said first web member defining a first load bearing surface for said truss, and an outboard side of said first web member forming an outer surface of said truss;

(e) mounting a plurality of open web members inboard of said first web member to interconnect the top chord member and the bottom chord member and thereby define the interior open webbing;

(f) at said first end of said truss, in steps (a) to (d), means including the top chord member, the bottom chord member and said first web member forming a first weight bearing I-beam section (1) for supporting said truss on the first load bearing surface in the structure, and (2) for being trimmable up to a distance as defined by the length of said first web member when necessary during installation in the structure to change the length of said truss;

making a plurality of the trusses in different lengths beginning at a first length and increasing in length by increments of said distance to a longest truss, and wherein the plurality of trusses provides a source of a truss of any length from said first length trimmed by said distance to the length of the longest truss by appropriate trimming of one of the trusses when the length needed is not said first length or other lengths corresponding to increasing increments of said distance;

stocking the trusses of different lengths whereby the trusses are made to inventory rather than to specification;

removing the trusses from the inventory as needed for construction;

trimming said first I-beam section of each one of the trusses when necessary during installation in the structure to change the length of the truss; and supporting each one of the trusses on its respective load bearing surfaces in the structure.

14. The method of claim 13 wherein the plurality of the trusses are in different lengths beginning at 4 feet and increasing in 2 foot increments to a longest truss such that the plurality of trusses provides a source of a truss of any length from 4 feet to the length of the longest truss by appropriate trimming of a truss when the length needed is not 4 feet or a 2 foot increasing increment thereof.

15. The method of claim 14 wherein said first web member is two feet long.

16. A method of constructing and installing floor, roof and/or ceiling joists in a structure utilizing a plurality of trusses each including an open web section comprising the steps of:

(a) forming a first vertical strut having a top and bottom with the distance between the top and bottom of said first strut being equal to the desired spacing between the chord members;

(b) mounting a first solid web member having a top and a bottom to said first strut with a side of said first web member being fixed to a side of said first strut;

(c) mounting the top chord member to the top of said first web member;

(d) mounting the bottom chord member to the bottom of said first web member so that the top of said first strut contacts the top chord member and the bottom of said first strut contacts the bottom chord member with said first strut spaced inwardly from a first end of the truss and said first web member extending outboard of said first strut, the bottom chord member having a bottom surface thereof beneath said first strut and said first web member defining a first load bearing surface for the truss; and an outboard side of said first web member forming an outer surface of said truss; means including the top chord member, the bottom chord member and said first web member forming a first weight bearing I-beam section (1) for supporting the truss on the first load bearing surface in the structure, and (2) for being trimmable up to a predetermined distance as defined by the length of said first web member when necessary during installation in the structure to change the length of the truss;

(e) mounting a second vertical strut between the chord members at a second end of the truss;

(f) repeating steps (a) to (e) to form a plurality of trusses with each including an open web section;

(g) making the plurality of trusses in different lengths beginning at a first length and increasing in length by increments of said predetermined distance to a longest truss, and wherein the plurality of trusses provides a source of a truss of any length from said first length trimmed by said predetermined distance to the length of the longest truss by appropriate trimming of one of the trusses when the length needed is not said first length or other lengths corresponding to increasing increments of said predetermined distance;

(h) stocking the plurality of trusses of different lengths whereby the trusses are made to inventory rather than to specification;

(i) removing the trusses from the inventory as needed for installation;

(j) trimming said first I-beam section of each one of the trusses when necessary during installation in the structure to change the length of the truss; and (k) supporting each one of the trusses on its respective first load bearing surface in the structure.

17. The method of claim 16 further comprising on each one of the trusses:

(l) mounting a second solid web member having a top and a bottom to said second vertical strut with a side of said second web member being fixed to a side of said second strut;

(m) mounting the top chord member to the top of said second web member;

(n) mounting the bottom chord member to the bottom of said second web member so that the top of said second strut contacts the top chord member and the bottom of said second strut contacts the bottom chord member with said second strut spaced inwardly from a second end of said truss and said second web member extending outboard of said second strut, the bottom chord member having a bottom surface thereof beneath said second strut and said second web member and outboard of said second strut for defining a second load bearing surface for said truss; and an outboard side of said second web member forming an outer surface of said truss;

(o) each one of the trusses having at its respective second end means including the top chord member, the bottom chord member and said second web member forming a second weight bearing I-beam section (1) for supporting said truss on the second load bearing surface in the structure, and (2) for being trimmable up to a distance as defined by the length of said second web member, wherein said truss is trimmable a total distance as defined by the sum of the lengths of said first and second web members when necessary during installation in the structure to change the length of said truss;

(p) trimming said second I-beam section of each truss when necessary during installation in the structure to change the length of said truss; and (q) supporting each truss on its respective second load bearing surfaces in the structure.

18. The method of claim 17 wherein said total distance is 2-feet, and wherein the plurality of different length trusses begin with said first length being 4-feet and increasing at increments of 2-feet to the longest truss such that the plurality of trusses provides a source of a truss of any length from 4-feet to the length of the longest truss by appropriate trimming of a truss when the length needed is not 4-feet or a 2-foot increasing increment thereof.

19. A method of constructing a family of trusses for installation in a structure comprising the following steps:

(a) forming a first solid web member having a top and a bottom;

(b) mounting a top chord member along a bottom thereof to the top of said first web member at a first end of a truss;

(c) mounting a bottom chord member along a top thereof to the bottom of said first web member at said first end of said truss; said bottom chord member having a bottom surface thereof beneath said first web member for a first load bearing surface of said truss; and an outboard side of said first web member forming an outer surface of said truss;

(d) mounting a plurality of members inboard of said first solid web member to interconnect said top chord member and said bottom chord member and thereby define an open web section;

(e) at said first end, in steps (a) to (c), making means including said top chord member, said bottom chord member and said first web member forming a first weight bearing I-beam section (1) for supporting said truss on the first load bearing surface in the structure, and (2) for being trimmable up to a predetermined distance when necessary during installation in the structure to change the length of said truss;

(f) repeating steps (a) to (e) to form a family of trusses with each including an open web section;

(g) making the family of trusses in different lengths beginning at a first length and increasing in length by increments of said predetermined distance as defined by the length of said first web member, and wherein the family of trusses provides a source of a truss of any length from said first length trimmed by said distance to the length of the longest truss by appropriate trimming of one of the trusses when the length needed is not said first length or other lengths corresponding to increasing increments of said distance;

(h) stocking the family of trusses of different lengths whereby the trusses are made to inventory rather than to specification;

(i) removing the trusses from the inventory as needed for installation.

20. The method of claim 19 wherein said first web member is two feet long.

21. The method of claim 19 wherein said first web member is one foot long.

22. A method of installing each one of the family of trusses of claim 19 comprising the steps of:

trimming the first I-beam section of the trusses when necessary during installation in the structure to change the length of the trusses; and supporting each one of the trusses on the first load bearing surface thereof in the structure.

23. A method of constructing a family of trusses for installation in a structure comprising the following steps:

(a) forming a first solid web member having a top and a bottom;

(b) mounting a top chord member along a bottom thereof to the top of said first web member at a first end of a truss;

(c) mounting a bottom chord member along a top thereof to the bottom of said first web member at said first end of said truss; said bottom chord member having a bottom surface thereof beneath said first web member for a first load bearing surface of said truss; and an outboard side of said first web member forming an outer surface of said truss;

(d) mounting a plurality of members inboard of said first solid web member to interconnect said top chord member and said bottom chord member and thereby define an open web section;

(e) at said first end, in steps (a) to (c), making means including said top chord member, said bottom chord member and said first web member forming a first weight bearing I-beam section (1) for supporting said truss on the first load bearing surface in the structure, and (2) for being trimmable when necessary during installation in the structure to change the length of said truss;

(f) forming a second solid web member having a top and a bottom;

(g) mounting said top chord member along the bottom thereof to the top of said second web member at a second end of said truss;

(h) mounting said bottom chord member along the top surface thereof to the bottom of said second web member at said second end of said truss; said bottom chord member having a second portion of the bottom surface thereof beneath said second web member for a second load bearing surface of said truss; and an outboard side of said second web member forming an outer surface of said truss;

(i) at said second end of said truss, in steps (f) to (h), making means including said top chord member, said bottom chord member and said second web member forming a second weight bearing I-beam section (1) for supporting said truss on the second load bearing surface in the structure, and (2) for being trimmable when necessary during installation in the structure to change the length of said truss, said truss being trimmable a predetermined distance equal to the sum of the amount trimmable from said first weight bearing I-beam section and said second weight bearing I-beam section, (j) repeating steps (a) to (i) to form a family of trusses with each including an open web section;

(k) making the family of trusses in different lengths beginning at a first length and increasing in length by increments of said predetermined distance, and wherein the family of trusses provides a source of a truss of any length from said first length trimmed by said predetermined distance to the length of the longest truss by appropriate trimming of one of the trusses when the length needed is not said first length or other lengths corresponding to increasing increments of said predetermined distance;

(l) stocking the family of trusses of different lengths whereby the trusses are made to inventory rather than to specification; and (m) removing the trusses from the inventory as needed for installation.

24. The method of claim 23 wherein said first and second solid web members are rectangular.

25. A method of installing each one of the family of trusses of claim 23 comprising the steps of:

trimming the first I-beam section and/or the second I-beam section of the trusses when necessary during installation in the structure to change the length of the trusses; and supporting each one of the trusses on the first and second load bearing surfaces in the structure.

26. The method of claim 23 wherein a strut is fixed to an inboard side of each one of said first and second solid web members and each one of the struts extends between said top and bottom chord members.

27. The method of claim 23 wherein said first web member and said second web member are each one foot long.

28. The method of claim 27 further comprising a plurality of fasteners for binding the plurality of members defining said open web section to said upper chord and said lower chord.

29. The method of claim 23 wherein said top and bottom chord members, said first and second web members and said open web structure members are made of wood.

30. The method of claim 29 further comprising binding said open web structure members to said top chord member and said bottom chord member with means including a plurality of fasteners.

31. The method of claim 30 wherein the fasteners are formed from sheet metal and have sharp points or have nails therethrough for binding said open web structure members to said top chord member and said bottom chord member.

32. The method of claim 29 wherein said first and second web members are comprised of oriented strand board.

* * * * *